US009269248B2

(12) United States Patent
Luterotti

(10) Patent No.: US 9,269,248 B2
(45) Date of Patent: Feb. 23, 2016

(54) ENVIRONMENTAL PARAMETER RESPONSIVE, ASPIRATED FIRE DETECTOR

(75) Inventor: Lorenzo Luterotti, Farra d'Isonzo (IT)

(73) Assignee: LIFE SAFETY DISTRIBUTION AG, Hegnau (CH)

( * ) Notice: Subject to any disclaimer, the term of this patent is extended or adjusted under 35 U.S.C. 154(b) by 763 days.

(21) Appl. No.: 12/553,542

(22) Filed: Sep. 3, 2009

(65) Prior Publication Data

US 2011/0050433 A1 Mar. 3, 2011

(51) Int. Cl.

| | |
|---|---|
| ***G08B 17/10*** | (2006.01) |
| *B05B 1/00* | (2006.01) |
| *A62C 2/00* | (2006.01) |

(52) U.S. Cl.

CPC . *G08B 17/10* (2013.01); *A62C 2/00* (2013.01); *B05B 1/00* (2013.01)

(58) Field of Classification Search

CPC ..... A62C 2/00; B05B 1/00
USPC ..... 340/628, 416; 73/31.02, 570
See application file for complete search history.

(56) References Cited

U.S. PATENT DOCUMENTS

| | | | | |
|---|---|---|---|---|
| 3,786,502 | A * | 1/1974 | Stendig et al. | 340/521 |
| 3,895,912 | A * | 7/1975 | Naumann | 422/93 |
| 7,493,816 | B1 | 2/2009 | Petrovic et al. | |
| 2009/0025453 | A1 * | 1/2009 | Griffith et al. | 73/31.02 |
| 2011/0201530 | A1 * | 8/2011 | Oldham et al. | 506/39 |

* cited by examiner

*Primary Examiner* — Shirley Lu
(74) *Attorney, Agent, or Firm* — Husch Blackwell LLP

(57) ABSTRACT

An aspirated smoke detector includes at least one ambient atmosphere inflow collection pipe with a plurality of inflow ports arranged along the pipe. The ports of the pipe are defined at least in part by temperature sensitive materials which alter the area of the respective inflow port in response to physical and/or chemical changes. As the temperature increases the area increases, thereby drawing more of the local ambient air and airborne particulate matter into the flow pipe, and then onto the smoke sensing chamber. This increased flow off-sets the dilution present due to other air in the respective pipe from other inflow ports which might not be near the developing fire condition.

20 Claims, 4 Drawing Sheets

ENVIRONMENTAL PARAMETER RESPONSIVE, ASPIRATED FIRE DETECTOR

FIELD

The invention pertains to aspirated smoke detectors. More particularly, the invention pertains to such detectors which respond to local physical and or chemical environment parameter changes, such as, for example, temperature increases, by increasing inflowing local ambient atmosphere from the region where the modified environment parameter has been sensed.

BACKGROUND

Various types of aspirated smoke detectors are known. One example is disclosed in U.S. Pat. No. 7,493,816 entitled, "Smoke Detectors" which issued Feb. 24, 2009. Another is disclosed in published US Patent Application 2009/0025453 entitled "Apparatus and Method of Smoke Detection" published Jan. 29, 2009. Both the '816 patent and the published '453 application are assigned to the assignee hereof and incorporated herein by reference.

Aspirated smoke detectors usually need a careful balance between sensitivity and nuisance rejection. Such detectors usually supervise a pretty wide area: in case of a fire, only a few holes in the aspirating pipe will be exposed to smoke/gas whilst most of the pipe still sucks clean air. So a large and unpredictable dilution effect will occur. Since the system must take in account the high dilution effect, high sensitivity—usually laser based—optical systems, are employed to maintain early fire detection in such conditions. This tends to limit the suitability of aspirated systems to clean environments such as computer rooms, telecommunication rooms or the like.

There is a need for aspirated detectors which might be usable in a broader range of environments.

DETAILED DESCRIPTION

Figure 1:
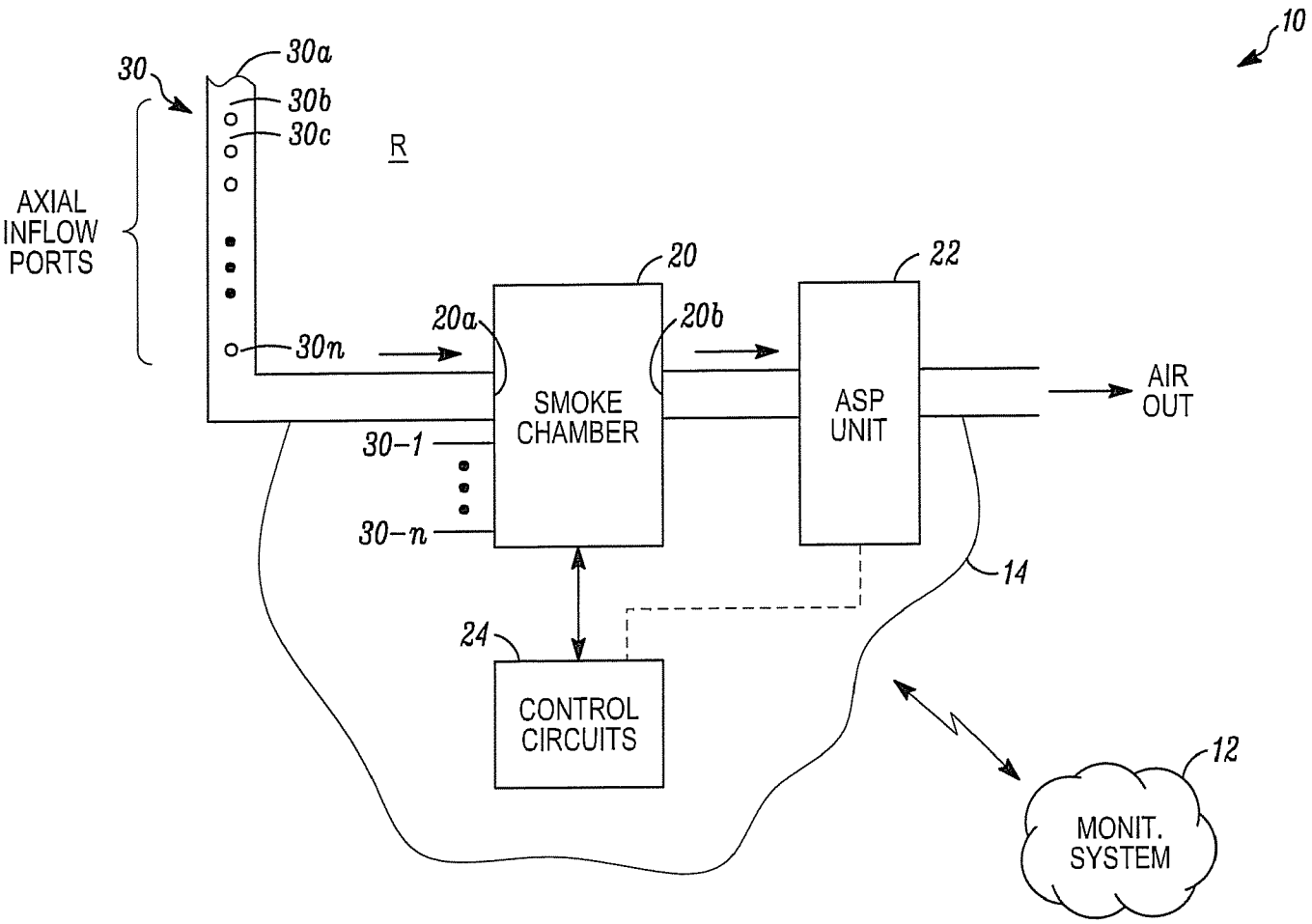
FIG. 1 is a diagram of an aspirated detector in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

In embodiments of the invention, an environmental stimulus, for example temperature, can be used to alter the size of aspirating ports, to increase ambient atmosphere inflow, or nozzle cross section. Since this process will occur only at the inflow ports closest to the fire/combustion phenomena, it will dramatically impact the amount of smoke/particulate/gas that is sucked or drawn into the collection pipe or conduit and will thus minimize the dilution effect. This would allow a prompt response, even with a lower sensitivity, thus reducing the occurrence of false alarm in normal or even in harsh environments.

All flaming fires release radiation energy. As a result, the ambient air in the vicinity is subjected to a measurable temperature increase. One embodiment of the invention employs bi-metallic or memory shaped alloy nozzles to adapt ambient air inflow hole size to ambient temperature. The higher the local temperature, the larger the inflow port becomes.

Embodiments of the invention can be sensitive to absolute temperature, rate of raise of temperature, or even differential temperature (compared to the air temperature sucked in the pipe). Most smoldering fires (i.e. negligible thermal contribution) will release high amounts of carbon monoxide (smoldering combustion is an oxygen poor-type of combustion so almost all organic fuels will led to a carbon monoxide rich gas compound release).

In order to increase a nozzle's active area that is responsive to such combustion, a layer of suitable catalyst could be deposited over the thermally sensitive element. Preferred catalyst materials are hopcalites, which are commercially available as carbon monoxide oxidants and sorbents. There are two main formulations of hopcalite: one is a mixture of about 50% MnO2, about 30% CuO, about 15% Co2O3, and about 5% Ag2O whilst the other contains about 60% MnO2 and about 40% CuO (David R. Merrill and Charles C. Scalione, J. Am. Chem. Soc., 43, 1921, p. 1982). Carbon monoxide hopcalite induced oxidation is highly exothermic (approx 60 Kcal/mol) so the detector will be fairly sensitive even to small amounts of CO (and consequently to smoldering combustion). CO dependant-hopcalite induced heat release has been used to implement a CO detector as described in expired U.S. Pat. No. 3,895,912 entitled, "Carbon Monoxide Monitor".

Another embodiment could employ an inflow pipe design with built in thermally sensitive material. The pipe might be co-molded as a bi-material arrangement: most of the pipe will be made of cheap standard ABS plastic blend and just a partial area of the pipe will present thermally sensitive material ready to be punched during system commissioning.

FIG. 1 illustrates an aspirated smoke detector 10, in accordance with the invention, monitoring a region R. Detector 10 is in wired or wireless communication with a monitoring system 12. Components of detector 10 can be carried by housing 14.

Detector 10 includes a smoke sensing chamber 20, for example a photo-electric type of sensor as would be understood by those of skill in the art. The details of chamber 20 are not limitations of the invention. Aspirated air and smoke flow in at inflow port 20*a* and out at port 20*b*.

An aspirating unit, fan or blower 22 draws or injects ambient atmosphere, and associated airborne particulate matter, smoke particles, into the chamber 20 where a concentration thereof can be sensed. Control circuits 24 coupled to chamber 20 and perhaps aspiration unit 22 evaluate a degree of smoke sensed in the chamber 24 as would be understood by those of skill in the art and need not discussed further. Control circuits 24 couple smoke concentration indicia to the monitoring system 12. Unit 22 could also be installed upstream of chamber 20 without departing from the spirit and scope of the invention.

Ambient atmosphere, including airborne particulate matter and gases, can be acquired from a plurality of different locations in the region R by use of a plurality of inflow conduits or pipes 30, 30-1 . . . 30-*n* which are coupled to the chamber 20. Each of the pipes, such as 30 is positioned in advance to provide smoke related information as to specific locations in the region R. A discussion of inflow conduit 30 also applies to 30-1 . . . **30-*n***.

Inflow conduit or pipe 30 is hollow with a distal end **30*a* (which might be open to receive ambient air and smoke or, most likely, present a suitable termination calibrated based on overall pipe design) into which local ambient air, or atmosphere, can be drawn by the aspirating unit 22. In addition, pipe 30 can be perforated at a plurality of displaced locations, such as 30*b*, 30*c* . . . 30*n*. These inflow ports or openings provide additional, location specific access points into region R for acquiring samples of the ambient air for analysis in chamber 20. If desired, inflow port 30*a* could be sealed with all samples coming from 30*b* . . . 30*n* without limitation. Other inflow pipes 30-1 . . . 30-*n*** are formed similarly.

Figure 1A:
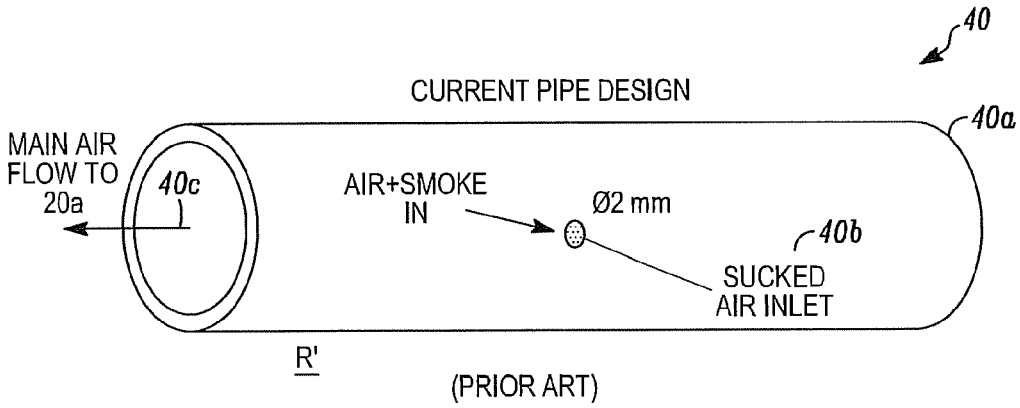
FIG. 1A illustrates an enlarged section of a prior art ambient air inflow pipe.

By way of explanation, FIG. 1A illustrates a section of prior art aspiration, atmospheric, inflow pipe 40. Pipe 40 illustrates a distal end **40*a*, which might be open or sealed, and an inflow port 40*b* through which ambient air at a location in a region R' being monitored could be drawn and directed, as at 40*c* to a sensing chamber of an aspirated detector. As explained above, air and smoke particulate matter inflowing via port 40*b* to be drawn into the respective smoke sensing chamber would become diluted by the much larger volume of air in pipe 40** which is being drawn thereinto from a variety of other points in the region R'.

FIGS. 2A-2D illustrate aspects of one embodiment of the invention. The inflow ports formed in the respective pipe 30, such as port **30*b*, are formed with a larger area than port 40*b* of FIG. 1A. All such ports are covered by a temperature responsive cover, or nozzle such as nozzle 32 of FIGS. 2B-2**D.

Nozzle 32 includes a bi-metallic element 34 with an opening **34*a* therethrough. Opening 34*a* is comparable to opening 40*b* of FIG. 1**A.

Figure 2A:
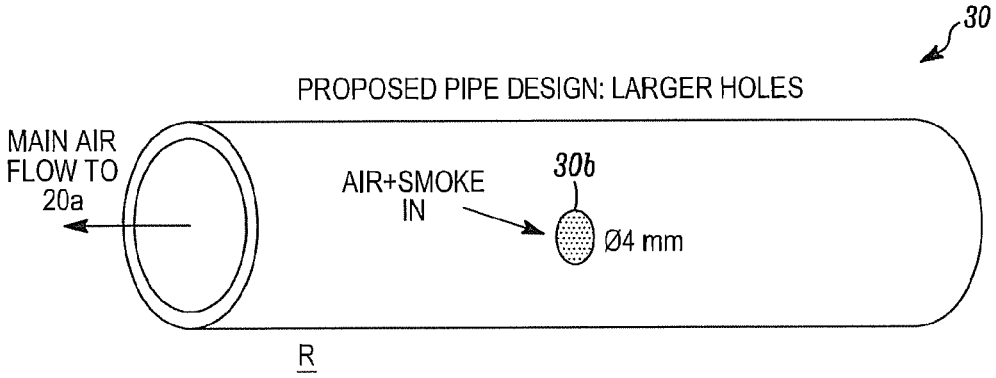
FIGS. 2A-2D illustrate aspects of one embodiment of a detector in accordance with the invention.
Figure 2B:
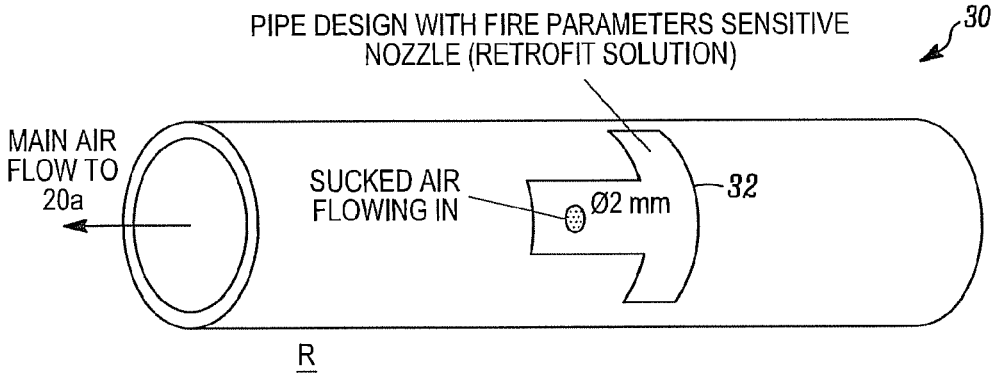
Figure 2C:
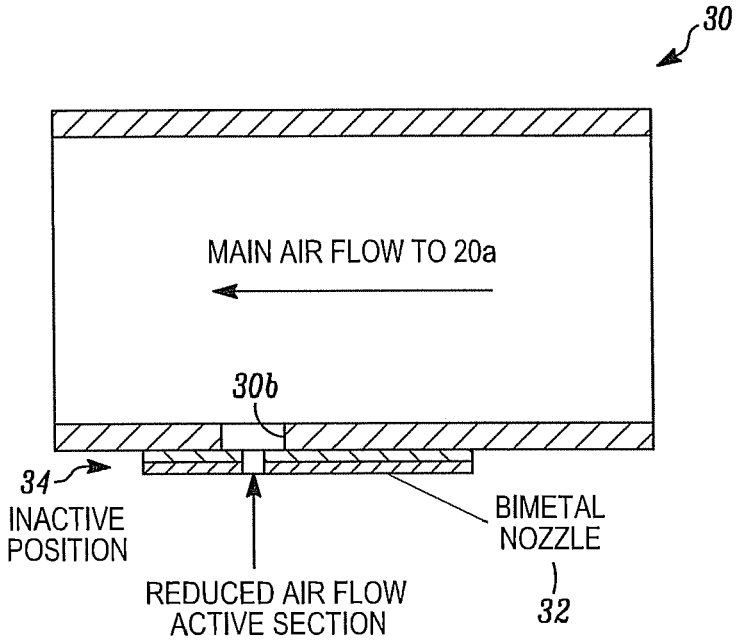
Figure 2D:
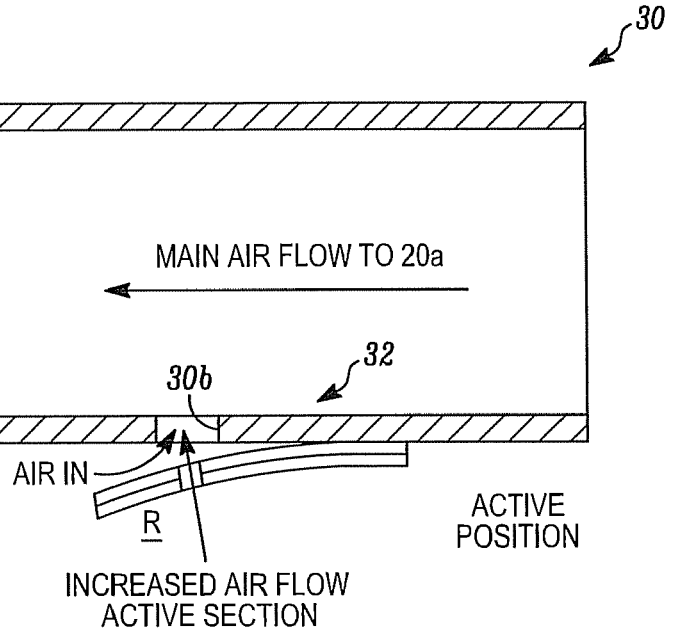

Nozzle 32 has a first, inactive state as in FIG. 2C and a second active state as in FIG. 2D. Nozzle 32 goes from the inactive position or state, FIG. 2C, to the active position or state, FIG. 2D, in response to the ambient air heating the element 32 due to a locally developing fire condition. As the element 32 moves to the active state, the amount of inflowing air increases into the pipe 30, thereby increasing the inflowing particulate matter and off-setting the above noted dilution effect due to being mixed with air in the main flow to the intake port **20*a*. As noted above, some or all of the nozzle 32 could be coated with an exothermic material or catalyst to increase the amount of local heat, thereby providing a larger air, and particulate matter, inflow area into the associated flow or collection pipe. Nozzle 32** provides a retrofit solution to be added to previously installed aspirated detectors.

Thermally sensitive nozzle designs could be optimized to maximize both convective (heat exchange radiators) and irradiated heat transfer (opaque dark color) from the ambient air towards the heat sensitive elements, i.e. to maximize temperature difference between the pipe (which will be kept at a fairly constant temperature form the air circulating inside) and the local environment.

Figure 3A:
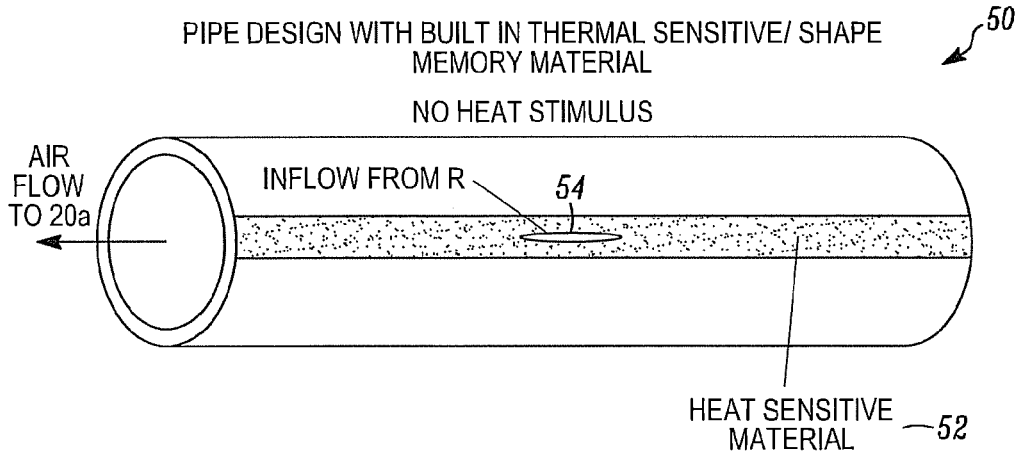
FIGS. 3A, 3B illustrate aspects of another embodiment of a detector in accordance with the invention.
Figure 3B:
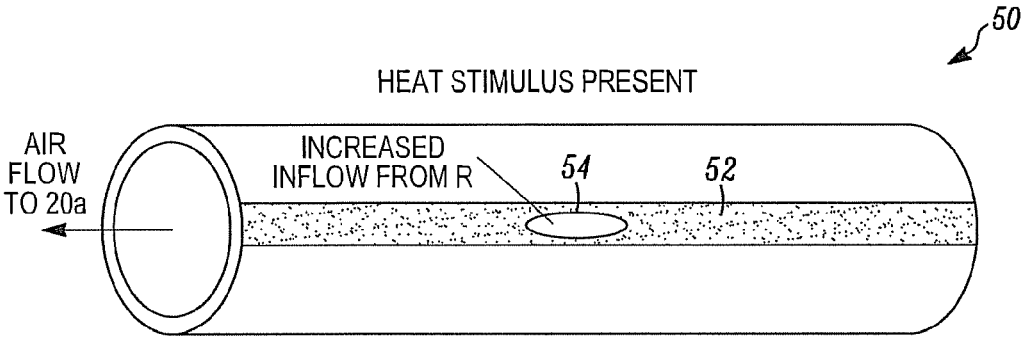

FIGS. 3A, 3B illustrate another embodiment of the present invention. In the embodiment of FIGS. 3A, 3B a thermally sensitive or responsive material 52 can be formed on a section of inflow or collector pipe 50. An opening 54 can be provided into the pipe 50, through the material 52.

In the absence of heat, the inflow port 54 has a first inflow area. In the presence of heat, due to heated air in the region R adjacent to the opening 54, the thermally responsive material 52 expands, thereby increasing the opening of the inflow port 54 so that an increased inflow from that part of the region R results. This, in turn, significantly increases the flow of airborne particulate matter from that portion of the region R adjacent to the opening 54 into the inflow port **20*a* of the smoke sensing chamber 20. A faster smoke or fire determination can then be made by the control circuits 24**.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An aspirated smoke detector comprising:

a smoke detection chamber;

an inflow duct with at least one fluid inflow port;

a blower that draws or sucks smoke from a fire within a region through the inflow duct and into the smoke detection chamber; and a thermally responsive element, adjacent to the inflow port, that responds to heat or combustion products from the fire, wherein the element alters an inflow area of the port by increasing a relative area of the input port in response to an adjacent ambient atmosphere, thereby offsetting dilution of smoke due to air entering the inflow duct from other inflow ports which are not near the fire, and wherein the increase of the relative area of the input port occurs only at the inflow port relatively closest to the fire.

2. A detector as in claim 1 where the element comprises one of a bi-metallic member, or a thermally responsive member.

3. A detector as in claim 2 where the element carries an exothermic catalyst.

4. A detector as in claim 3 where the catalyst interacts with at least one ambient gas and responsive thereto, heats the element, at least in part.

5. A detector as in claim 2 where the bi-metallic member, responsive to an increase in ambient temperature, moves from a first position, associated with a first temperature, to a second position, associated with a second temperature, where the second temperature is higher than the first temperature, thereby increasing the inflow area of the port.

6. A detector as in claim 2 where the thermally responsive member is deposited as a layer on the duct.

7. A detector as in claim 1 which includes an aspiration unit coupled to the duct to draw ambient air into the duct via the port.

8. A detector as in claim 7 which includes a smoke sensing chamber coupled to the inflow port.

9. A detector as in claim 1 where the thermally responsive element comprises an elongated section of thermally responsive material, a portion of which surrounds the inflow port.

10. A detector as in claim 9 which includes an aspiration unit coupled to the duct to draw ambient air into the duct via the port.

11. A detector as in claim 10 where the element comprises an exothermic catalyst.

12. A detector as in claim 11 where the catalyst comprises a selected hopcalite.

13. A detector as in claim 9 where the thermally responsive element comprises a thermally sensitive nozzle which carries an exothermic material.

14. A detector as in claim 13 where a portion of the nozzle moves in response to local heat from the exothermic material.

15. An aspirated detector comprising:

a housing;

a smoke sensing chamber carried by the housing;

an aspirating unit coupled to the chamber;

an inflow duct, coupled to the sensing chamber, with at least one fluid inflow port, the aspirating unit draws or sucks smoke from a fire within an area through the inflow duct into the smoke sensing chamber; and a thermally responsive element, adjacent to the inflow port, that responds to heat or combustion products from the fire, wherein the element alters an inflow area of the port by increasing a relative area of the inflow port in response to temperature of an adjacent ambient atmosphere, thereby offsetting dilution of smoke due to air entering the inflow duct from other inflow ports which are not near the fire, and wherein the increase of the relative area of the input port occurs only at the inflow port relatively closest to the fire.

16. A detector as in claim 15 where the element comprises one of a bi-metallic member, or a thermally responsive member.

17. A detector as in claim 16 where the element carries an exothermic catalyst.

18. A detector as in claim 17 where the catalyst interacts with at least one ambient gas and responsive thereto, heats the element, at least in part.

19. A detector as in claim 16 where the bi-metallic member, responsive to an increase in ambient temperature, moves from a first position, associated with a first temperature, to a second position, associated with a second temperature, where the second temperature is higher than the first temperature, thereby increasing the inflow area of the port.

20. An aspirated smoke detector comprising:

a smoke detection chamber;

an inflow duct with at least one fluid inflow port; and a blower that draws or sucks smoke from a fire, along with ambient air from within a region, through the inflow duct and into the smoke detection chamber, where the duct includes a co-molded element, which includes, at least in part, an exothermic catalyst, adjacent to the inflow port, wherein the element alters an inflow area of the port by increasing a relative area of the inflow port in response to carbon monoxide from the fire, thereby offsetting dilution of smoke due to air entering the inflow duct from other inflow ports which are not near the fire, and wherein the increase of the relative area of the input port occurs only at the inflow port relatively closest to the fire.

* * * * *